US007313875B2

(12) United States Patent
Morgan

(10) Patent No.: US 7,313,875 B2
(45) Date of Patent: Jan. 1, 2008

(54) FOOTWEAR OUTSOLE

(75) Inventor: Mark M. Morgan, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 385 days.

(21) Appl. No.: 11/020,469

(22) Filed: Dec. 22, 2004

(65) Prior Publication Data

US 2006/0130368 A1 Jun. 22, 2006

(51) Int. Cl.
*A43B 23/28* (2006.01)
*A43B 13/18* (2006.01)

(52) U.S. Cl. ..... 36/59 C; 36/32 R; 36/59 R; 36/25 R

(58) Field of Classification Search ..... 36/59 C, 36/32 R, 59 R, 28, 134, 25 R, 67 R, 30 R
See application file for complete search history.

(56) References Cited

U.S. PATENT DOCUMENTS 3,005,272 A * 10/1961 Shelare et al. ..... 36/29
3,006,085 A * 10/1961 Bingham, Jr. ..... 36/59 C
3,581,414 A * 6/1971 Crawford ..... 36/59 R
4,083,125 A * 4/1978 Benseler et al. ..... 36/32 R
4,241,524 A * 12/1980 Sink ..... 36/102
4,631,842 A * 12/1986 Koskela ..... 36/103
4,769,931 A * 9/1988 Morrow et al. ..... 36/134
5,216,824 A 6/1993 Blissett et al.
5,768,802 A * 6/1998 Bramani ..... 36/28
5,918,385 A 7/1999 Sessa
6,029,377 A * 2/2000 Niikura et al. ..... 36/67 R
6,792,698 B2 * 9/2004 Kobayashi et al. ..... 36/59 C
2002/0004999 A1 * 1/2002 Caine et al. ..... 36/129
2002/0040539 A1 * 4/2002 Kobayashi et al. ..... 36/127
2002/0144429 A1 * 10/2002 Hay ..... 36/25 R

* cited by examiner

*Primary Examiner*—Marie Patterson
(74) *Attorney, Agent, or Firm*—Warner Norcross & Judd LLP

(57) ABSTRACT

An outsole for an article of footwear including a base and a plurality of lugs extending from the base in the forefoot and in the heel portions of the outsole. The lugs each include a leading edge and a trailing edge, and are individually contoured to include a profile increasing in height relative to the base from the leading edge to the trailing edge. The plurality of lugs can also collectively form a contour having an increasing height profile from toe to heel in both the forefoot portion and the heel portion of the outsole. The shape of the lugs, both individually and collectively, permits efficient energy return when walking and simultaneously provides localized, independent reactivity to accommodate a wearer's pressure profile and gait.

20 Claims, 4 Drawing Sheets

FOOTWEAR OUTSOLE

BACKGROUND OF THE INVENTION

The present invention relates to footwear, and more particularly to an outsole construction for an article of footwear.

Walking, whether as a form of exercise or in connection with some other outdoor activity, has gained and retained popularity in recent years. Walking for extended periods of time can be strenuous and uncomfortable without a well-designed shoe.

U.S. Pat. No. 5,216,824 to Blissett et al discloses a sole for a walking shoe. In one illustrated embodiment, the sole includes one integral, contoured pad in the forefoot, and another, integral contoured pad in the heel. These large pads provide efficient energy return when walking on flat surfaces. Blissett observes that an integral pad having a rearwardly increasing profile and a void space that compresses during walking exhibits a "synergistic function with the natural biomechanism of the foot in attenuating ground reaction forces associated with impact and efficient toe-off efficiency by reducing the amount of force necessary to propel the body forward." Col. 4, Lns. 6-10.

Despite the benefits provided by the Blissett sole construction, there exists a need for a sole that has favorable walking properties (i.e. comfort and efficient energy return) and is adaptable to a variety of walking surfaces. The present invention addresses this need by providing a single outsole design that not only is efficient for walking, but also adapts to irregular surfaces and a wearer's gait.

SUMMARY OF THE INVENTION

The aforementioned goals are met by the present invention which relates to an outsole for an article of footwear. The outsole is made from a flexible material and includes a forefoot base and a heel base. Multiple lugs are disposed on both the forefoot base and the heel base. Each lug includes a lug surface which can contact a walking surface. The lug surfaces are contoured so that the profile of each lug increases in height from the front of the lug to the rear of the lug. Multiple independent lugs may be arranged in a grid-like pattern on the outsole.

In one embodiment, multiple lugs may collectively follow a common contour. For example, a collective set of lugs in the forefoot may be contoured such that the vertical distance from the outsole base to a lug wearing surface is substantially rearwardly increasing from lug to lug, as the lugs progress from toe to heel of the outsole. A collective set of lugs on the heel of the outsole may also include such a common contour.

In another embodiment, a set of multiple lugs can include features that follow one or more common contours. For example, each forefoot lug can includes a leading contour and a trailing contour. The leading contour can be at the front of a lug wearing surface, and the trailing lug can be at the rear of a lug wearing surface. The leading contours of multiple lugs form a set of lugs which follow a common contour. This common contour can be, for example, a first arc having a constant radius. The trailing contours of those lugs in the set can follow another common contour. This other contour can be, for example, another arc which is identical to, but offset from, the first arc. For example, the center of the second arc can be positioned a select distance above the center of the first arc. In yet another embodiment, the leading contours of the multiple lugs which form a set of lugs can follow another common contour, and the trailing contours of those lugs in the set can follow a different contour. A different contour is positioned so that the trailing contour of a given lug is lower in space than the leading contour, for example, the trailing contour extends farther from the base of the outsole than the leading contour.

In yet another embodiment, the wearing surfaces of each individual lug can be substantially coincident with a lug wearing surface contour having a constant radius of curvature. In this embodiment, each lug wearing surface contour can follow a constant radius arc that intersects the leading contour and trailing contour (or projections thereof) of each lug.

The present invention provides an outsole that reacts to a particular wearer's pressure profile and gait, but simultaneously provides efficient energy return and adapts to uneven walking surfaces. In the present invention, large, single forefoot and heel lugs are replaced with a multiple smaller, independent lugs. Each smaller lug can move and react independent from its respective base and other lugs. This permits the sole to adapt to a wide variety of individualized gait patterns in a comfortable, yet efficient, manner. The flexible, independent movement of the multiple lugs also allows the outsole to conform to irregular walking surfaces and provide traction without substantially disrupting efficient energy return. Furthermore, the aligned lug contours, both individually and collectively, permit the outsole to provide efficient energy return and generate a spring-like effect which results in a gradual lifting and pushing force in the direction of walking.

These and other objects, advantages, and features of the invention will be readily understood and appreciated by reference to the detailed description of the preferred embodiment and the drawings.

DETAILED DESCRIPTION OF THE INVENTION

I. Construction

Figure 1:
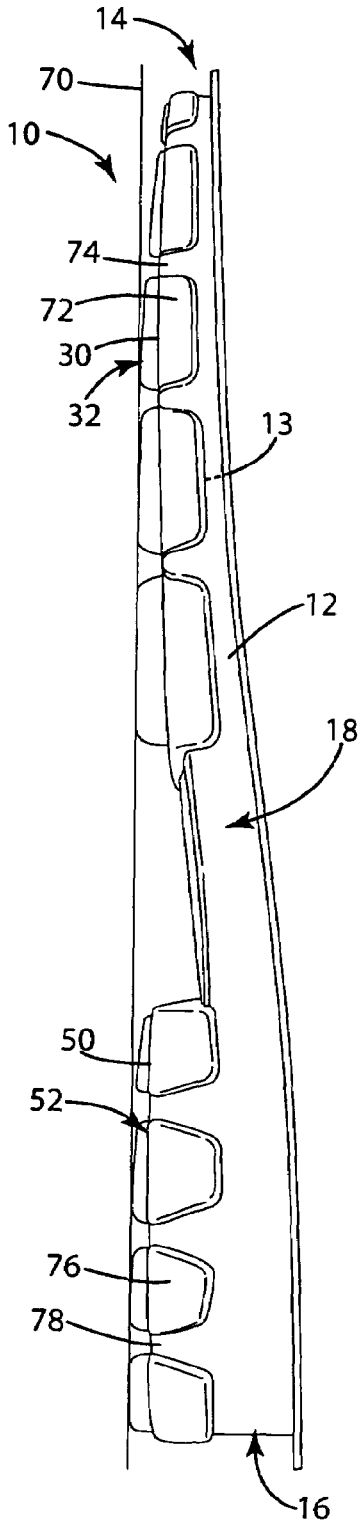
FIG. 1 is a bottom plan view of an outsole according to an embodiment of the invention.

An outsole for an article of footwear in accordance with an embodiment of the present invention is shown in FIGS. 1-6, and generally designated 10. The outsole 10 includes a forefoot portion 14 and a heel portion 16. The forefoot portion 14 and heel portion 16 are bridged by an arch 18. The outsole and components are further bounded by a peripheral wall 12. The forefoot portion 14, heel portion 16, arch 18 and peripheral wall can further cooperate to define an upwardly opening outsole recess 13, which can be filled with a cushioning material, such as EVA.

Figure 3:
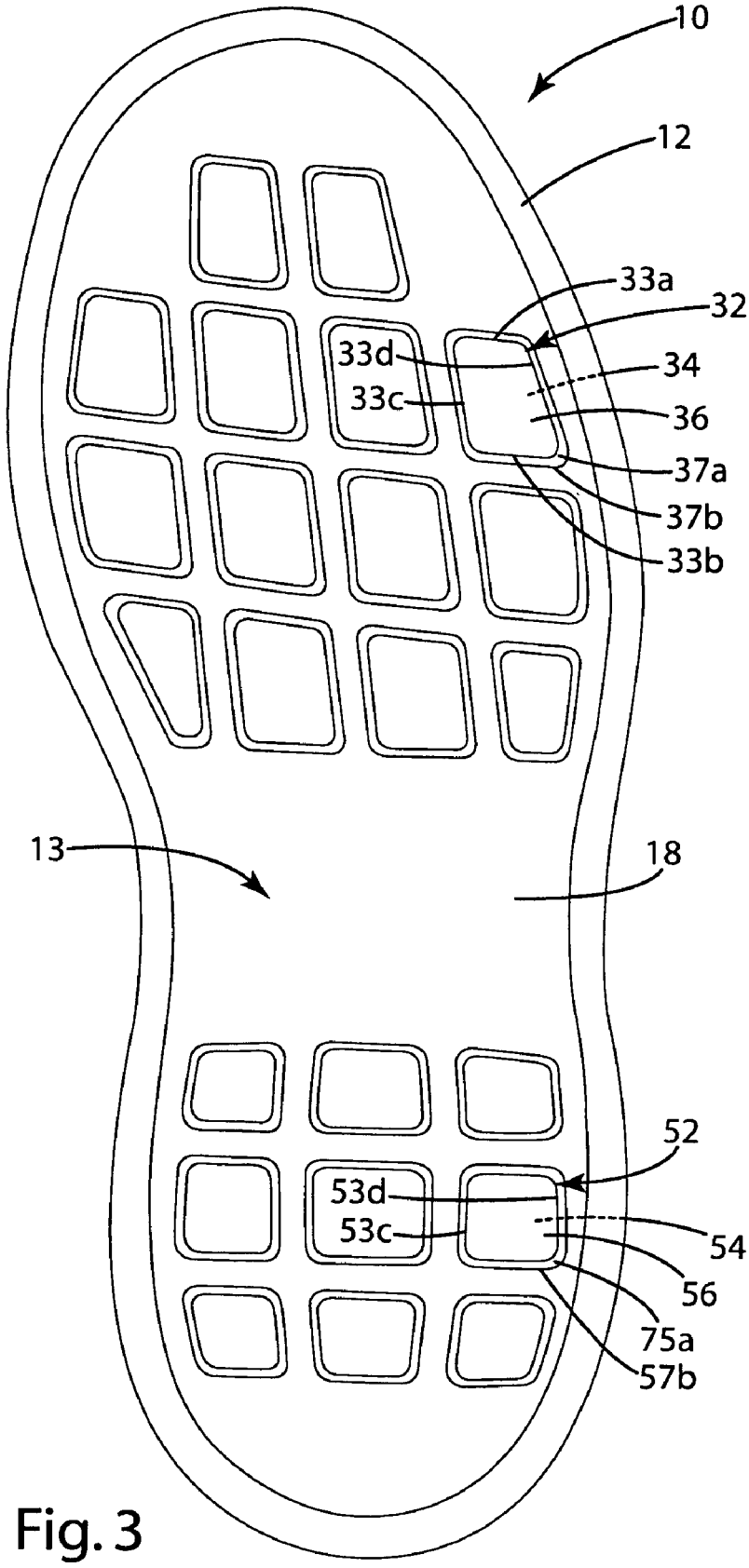
FIG. 3 is a top plan view of the outsole.

The forefoot portion 14 includes a forefoot base 30, which can extend downwardly from the remainder of the outsole 10. Multiple forefoot lugs 32 are included on the base 30. Each forefoot lug 32 includes a forefoot lug bottom surface 34 and a forefoot lug top surface 36, and each is surrounded by a forefoot lug channel 38 (FIG. 3). Each forefoot lug channel 38 is defined in the forefoot base 30, and specifically defined by forefoot lug channel walls 37*a*, 37*b*, and the walls that form the lug, e.g. leading wall 33*a* and trailing wall 33*b*, as well as the side walls 33*c*, 33*d* of the lug.

The bottom of heel portion 16 includes a heel base 50, which can extend downwardly from the remainder of the outsole 10. Multiple heel lugs 52 are included on the base 50. Each heel lug 52 includes a heel lug bottom surface 54 and a heel lug top surface 56, and each is surrounded by a heel lug channel 58 (FIG. 3). Each heel lug channel 58 is defined in the heel base 50, and specifically defined by heel lug channel walls 57*a*, 57*b* and the walls that form the lug, e.g. the heel lug leading wall 53*a*, the heel lug trailing wall 53*b*, as well as the side walls 53*c*, 53*d* of the lug.

Figure 4:
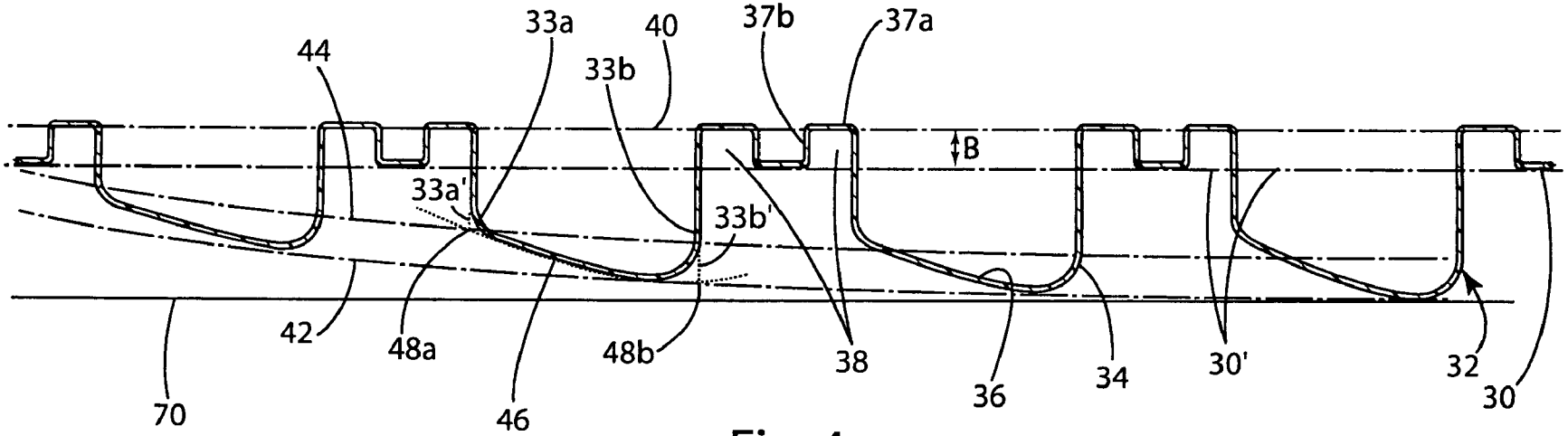
FIG. 4 is a cross sectional view of the forefoot portion of the outsole along line 4-4 of FIG. 1.
Figure 6:
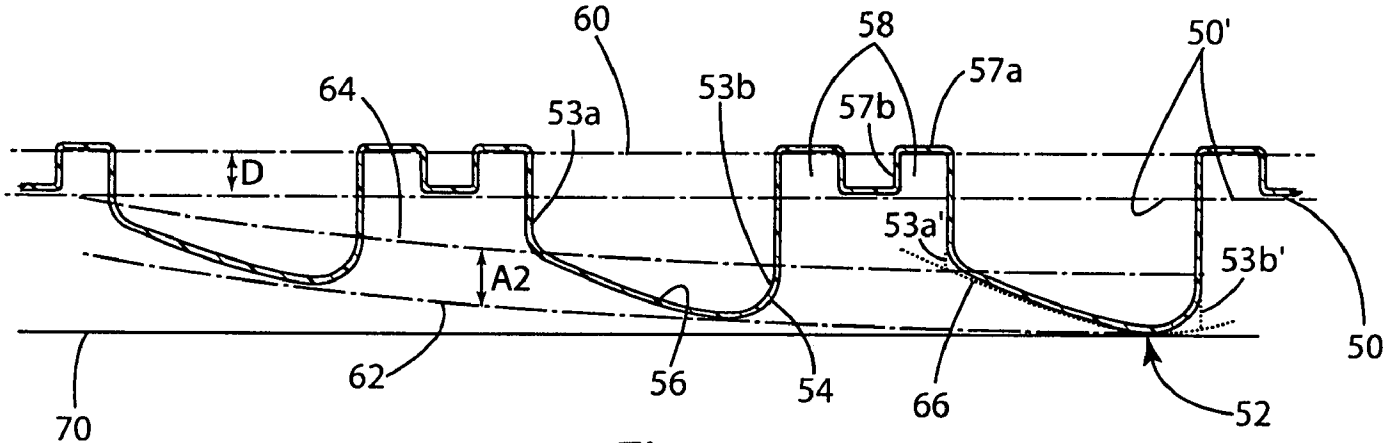
FIG. 6 is a cross sectional view of the heel portion of the outsole along line 6-6 of FIG. 1.

With reference to FIGS. 4 and 6, the forefoot lug channels 38 and heel lug channels 58 can provide an optional void around each respective forefoot and heel lug. In turn, this void can facilitate the independent movement and/or compression of each forefoot lug 32 and heel lug 52. This independent movement can enable the outsole 10 to adapt to a wearer's gait and provide efficient energy return while walking. Furthermore, independent movement enables each forefoot lug 32 and heel lug 52 to behave as a spring-like element, which compresses and expands at the appropriate point in a wearer's stride. Further, the independent compression of each forefoot lug 32 and each heel lug 52 can permit certain lugs to accommodate irregularities on a walking surface 70 while still allowing the remaining lugs to fulfill the efficient energy return function.

Optionally, the forefoot lug bottom surface 34 defines one or more grooves 39, and the heel lug bottom surfaces 54 define one or more grooves 59. The grooves 39 and 59 can provide additional traction and gripping force when a walking surface 70 is wet and/or irregular.

Figure 2:
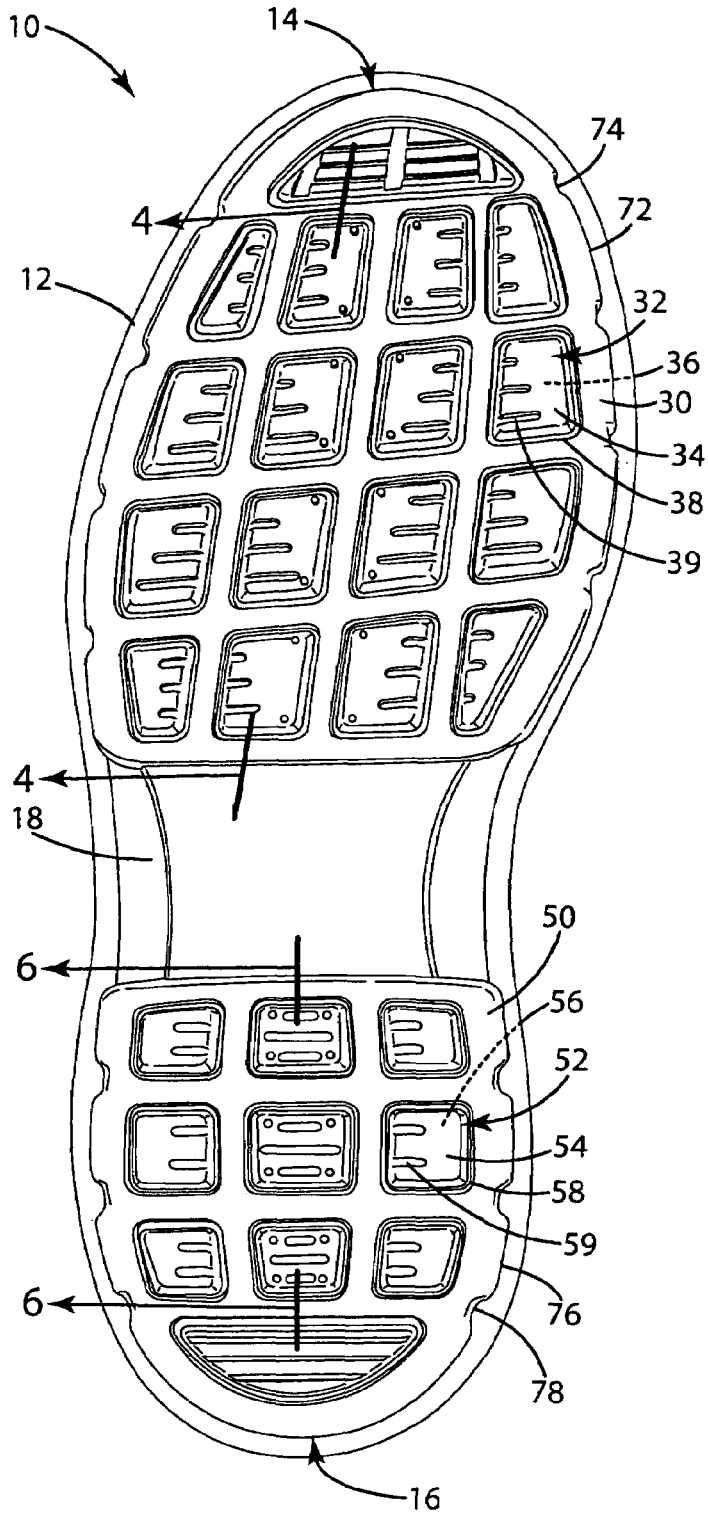
FIG. 2 is a side elevational view of the outsole.

As shown in FIGS. 1 and 2, the outsole 10 optionally can include false forefoot lug protrusions 72. These protrusions 72 can be separated by forefoot edge undercuts 74. In one embodiment, these protrusions can be part of the outsole peripheral wall 12. Specifically, the protrusions can be a thicker region of the wall 12 as compared to other portions of the wall. The heel portion 16 similarly can include false heel lug protrusions 76 that are separated from one another by heel edge undercuts 78.

Figure 5:
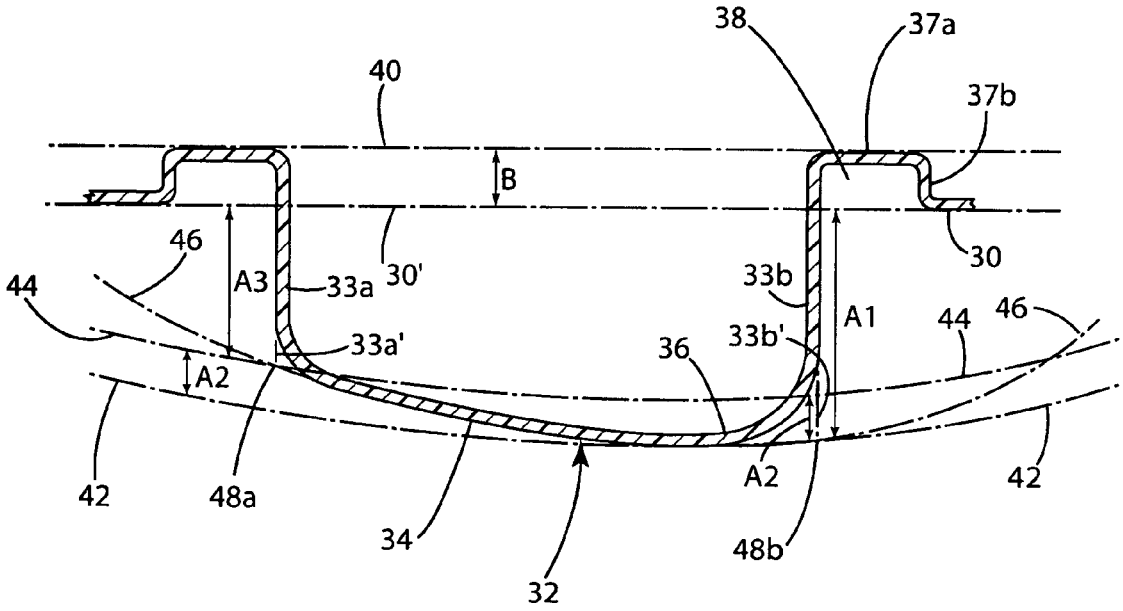
FIG. 5 is a cross sectional view of an outsole lug.

As shown in FIGS. 4 and 5, each of the forefoot lugs 32 can include forefoot lug leading portions and forefoot lug trailing portions, i.e., portions of the lugs that are close to the front of the lug and the rear of the lug, respectively. The forefoot lug leading portions can include a forefoot lug leading edge 48*a*; and the forefoot lug trailing portion can include a forefoot lug trailing edge 48*b*. These edges can be located at the actual intersection of the forefoot leading wall 33*a* and the forefoot lug bottom (or wearing) surface 46; and the intersection of the forefoot lug trailing wall 33*b* and the forefoot wearing surface 46, respectively. Alternatively, the edges can be rounded-off, in which case, the edges are generally aligned with points in space that correspond to the intersection of the forefoot lug leading contour 44 and forefoot leading wall projection 33*a*'; and the forefoot lug trailing contour 42 and the forefoot trailing wall projection 33*b*'.

The forefoot lug leading contour and forefoot lug trailing contour can be of any desired configurations. For example, as shown in FIG. 5, the forefoot lug leading contour 44 can be an arc with a constant radius of curvature. The forefoot lug leading edges 48*a* of all of the forefoot lugs can be collectively aligned along this forefoot lug leading contour 44. In general, the forefoot lug leading contour can intersect the forefoot lug leading wall 33*a* or the forefoot lug leading wall projection 33*a*' at a distance A3 from the base 30 and/or base projection 30'. Generally, this distance (or height) A3 increases from toe to heel so that the forefoot lug leading edge portion gradually increases in profile from toe to heel in the forefoot region among the multiple lugs.

The forefoot lug trailing contour 42 also can be of any configuration. As shown in FIG. 5, the contour 42 can be an arc with a constant radius of curvature that is the same as that of the arc forming the forefoot lug leading contour 44. The forefoot lug trailing edges 48*b* of all the forefoot lugs can be collectively aligned along this forefoot lug trailing contour 42. In general, the forefoot lug trailing contour intersects the forefoot lug trailing wall 33*b* or the forefoot lug trailing wall projection 33*b*' at a distance A1 from the base 30 and/or base projection 30'. Generally, this distance (or height) A1 increases from toe to heel so that the forefoot lug trailing edge portion gradually increases in profile from toe to heel in the forefoot region among the multiple lugs. Accordingly, the rearmost forefoot lugs or row of lugs 32 in the forefoot region 14 can be about 4.0 mm to about 5.0 mm in height measured from the base 30 and/or base projection 30'.

With each of the forefoot lug trailing edges 48*b* aligned with and generally following the forefoot lug trailing contour 42, the plurality of lugs in the forefoot region collectively form a collective contour having an increasing profile in height relative to the base 30 and/or base projection 30' as this collective contour transitions in the direction of the toe toward the heel on the outsole.

In a specific embodiment, the arcs forming the forefoot lug leading contour 44 and forefoot lug trailing contour 42 can be congruent, but offset from one another a distance A2. For example, the centers of the arcs can be offset so that one center is a distance A2 above the other center. This distance A2 can be about 1.2 mm to about 1.7 mm. Accordingly, in this embodiment, the vertical distance between the leading edge 48*a* and trailing edge 48*b* of each lug can generally be the same distance A2.

In addition, each individual lug can include an independent contour having an increasing height relative to the base 30 and/or base projection 30' as the independent contour transitions from the leading edge of the lug to the trailing edge of the lug. For example, as shown in FIG. 5, the forefoot lug 32 can include forefoot lug bottom surface contour 46 (or independent contour), which can generally follow an arc having a constant radius of curvature. This forefoot lug bottom surface contour 46 can be configured so that it intersects both the forefoot lug leading edge 48*a* and the forefoot lug trailing edge 48*b*. Of course, the corners in the leading portion and trailing portion of the lugs can be rounded-off so that the wearing surface 34 of the lug corresponds with the substantial portion of the forefoot lug bottom surface contour 46. Additionally, the bottom surface contour 46 can be disposed substantially between the forefoot lug leading contour 44 and the forefoot lug trailing contour 42, without extending beyond or below the forefoot lug trailing contour 42.

Each of the plurality of heel lugs can be constructed similar to the forefoot lugs. For example, each of the heel lugs 5*b* can also include an independent contour that transitions from a leading edge of the heel lug to a trailing edge of the heel lug with an increasing profile relative to the heel base 50 and/or base projection 50'. The heel lugs may also follow the collective contour so that the lugs have a collective profile and/or height relative to the base or base projection that increases as that contour transitions from the arch 18 to the heel. These heel lug contours also can have similar dimensions as the contours discussed above in connection with the forefoot lugs. For example, a heel lug leading contour can be an arc that is offset from a heel lug trailing contour, which is also an arc, a maximum distance of about 1.2 mm to about 1.7 mm. Likewise, the rearmost heel lug 52 or row of heel lugs can extend about 4.0 mm to about 5.0 mm from the heel base 50 and/or heel base projection 50'.

The outsole 10 can be constructed in a variety of common shoe sizes. For the different sizes, the radii of curvature of each lug-leading contour and lug-trailing contour can vary as desired. For example, for a size 8 outsole, the radius of curvature of the forefoot lug trailing contour 42 and the forefoot lug leading contour 44, as well as the corresponding heel lug trailing contour and the heel lug leading contour—when these contours are arcs—can be about 613.2 mm. These surface contours can also differ to accommodate varying shoe sizes and/or tread applications. In general, the radii of curvature of the various contours can be about 100 mm to about 2000 mm for varying sized shoes.

As shown in FIGS. 4 and 6, the forefoot lug top contour 40 can be coincident at certain locations with forefoot lug channel walls 37*a*. The forefoot lug channels 38 can be of depths B, which are the vertical distances between the forefoot base projected surface 30' and the forefoot lug top contour 40 and/or the lug channel walls 37*a*. The forefoot lug channel depths B can be rearwardly increasing, i.e., increasing in depth from toe to heel, to provide a greater spring-like effect at the location of initial impact of the forefoot portion 14 (e.g., in the region of the forefoot adjacent the arch 11).

Similarly, the surface denoted as heel lug top contour 60 can be coincident at certain locations with the heel lug channel walls 57*a*. The heel lug channels 58 can be of depths D, which are the vertical distances between a heel base projected surface 50' and a heel lug top contour 60 and/or the lug channel walls 57*a*. The lug channel depths D can be rearwardly increasing, i.e., increasing in depth from arch to heel, to provide greater spring-like effect at the location of initial impact of the heel portion 16.

II. Manufacture

Manufacture of footwear including an outsole of the present invention will now be described with reference to FIGS. 1-3. In general, the outsole 10 is molded from vulcanized rubber in a mold (not shown). The outsole 10 is removed from the mold to cure. The cured outsole 10 is cleaned with a well-known cleaning agent.

After cleaning, urethane cement is applied on the interior of the recess 13, for example, to the peripheral wall 12, the forefoot portion 14, heel portion 16 and arch 18.

The outsole 10 is placed in a conventional carrier and the urethane cement is flash-activated with heat lamps. Gas-infused polyurethane is then poured into the recess 13 of the outsole 10. Such gas-infused polyurethane is commercially available from Bayer Corp. of Germany. The fill pattern, rate, and amount of gas-infused polyurethane is precisely controlled by mechanical and computer apparatus, and is selected to account for subsequent expansion of the polyurethane. An upper is then clamped to the outsole 10 via the periphery 12. The article of footwear is held in this state as the gas-infused polyurethane foams and cures. In this manner, the polyurethane direct attaches the outsole 10 and the upper (not shown). Thereafter, the article of footwear is readied for subsequent processing.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. An outsole for an article of footwear comprising:

a forefoot base defining a plurality of forefoot lug channels;

a plurality of forefoot lugs joined with the forefoot base, each forefoot lug including a forefoot lug leading portion, a forefoot lug trailing portion, and a forefoot lug ground contacting bottom surface, the forefoot lug ground contacting bottom surface disposed a first distance from the forefoot base, the first distance increasing from the forefoot lug leading portion to the forefoot lug trailing portion on each forefoot lug so that each forefoot lug has a rearwardly increasing profile, each of said forefoot lugs surrounded by at least one of the forefoot lug channels;

a heel base defining a plurality of heel lug channels; and a plurality of heel lugs joined with the heel base, each heel lug including a heel lug leading portion, a heel lug trailing portion, and a heel lug ground contacting bottom surface, the heel lug ground contacting bottom surface disposed a second distance from the heel base, the second distance increasing from the heel lug leading portion to the heel lug trailing portion on each heel lug so that each heel lug has a rearwardly increasing profile, each of said heel lugs surrounded by at least one of the heel lug channels.

2. The outsole of claim 1 wherein the plurality of forefoot lugs are collectively aligned along an arcuate contour having a rearwardly increasing profile.

3. The outsole of claim 1 wherein the forefoot lug leading portions of the plurality of forefoot lugs are collectively aligned along a forefoot lug leading contour and wherein the forefoot lug trailing portions of the plurality of forefoot lugs are collectively aligned along a forefoot lug trailing contour, wherein the forefoot lug leading contour is congruent with a first arc, wherein the forefoot lug trailing contour is congruent with a second arc.

4. The outsole of claim 3 wherein the first arc and the second arc are congruent but offset from one another an amount.

5. The outsole of claim 1 wherein the heel lug leading portions of the plurality of heel lugs are collectively aligned along a heel lug leading contour and wherein the heel lug trailing portions are collectively aligned along a heel lug trailing contour.

6. The outsole of claim 5 wherein the heel lug leading contour is congruent with a first arc, wherein the heel lug trailing contours congruent with a second arc.

7. The outsole of claim 6 wherein the first arc and a second arc are congruent but offset from one another an amount.

8. The outsole of claim 1 wherein the forefoot lug trailing portions are aligned along a forefoot lug trailing contour and wherein the heel lug trailing portions are aligned along a heel lug trailing contour, and wherein a maximum distance between the forefoot lug trailing contour and the forefoot base is about 4.0 mm to about 5.0 mm and wherein a maximum distance between the heel lug trailing contour and the heel base is about 4.0 mm to about 5.0 mm.

9. The outsole of claim 2 wherein the plurality of heel lugs are collectively aligned along another arcuate contour having a rearwardly increasing profile.

10. The outsole of claim 5 wherein the heel lug leading contour and the heel lug trailing contour are separated by a distance of about 1.2 mm to about 1.7 mm.

11. The outsole of claim 1 wherein the forefoot lug channel is of a first depth and the heel lug channel is of a second depth, wherein the first depth and second depth increase from toe to heel in the footwear.

12. An outsole for an article of footwear comprising:

a base; and a plurality of lugs joined with the base, each lug including a leading edge and a trailing edge, the leading edge aligned with a first point that lies on a first arc, the trailing edge aligned with a second point that lies on a second arc, the first arc and second arc being congruent, the first arc offset from the second arc a pre-selected amount so that the leading edge is closer to the base than the trailing edge on each of the plurality of lugs, the plurality of lugs collectively forming a common rearwardly increasing profile.

13. The outsole of claim 12 wherein each of the lugs includes a profile that increases as the profile transitions from the leading edge to the trailing edge.

14. The outsole of claim 13 wherein the profile forms a contour.

15. The outsole of claim 14 wherein the contour includes a portion that is coincident with a third arc.

16. The outsole of claim 14 wherein the contour does not extend beyond the second arc.

17. The outsole of claim 12 wherein each lug is surrounded by a channel having a depth, the depth increasing in a direction from heel to toe of the outsole.

18. An outsole for an article of footwear comprising:

a base;

a plurality of lugs extending from the base, each lug including a leading edge and a trailing edge, each lug including an independent contour having a rearwardly increasing profile relative to the base as the independent contour transitions from the leading edge to the trailing edge, wherein the plurality of lugs collectively form a collective ground contacting contour having another rearwardly increasing profile relative to the base as the collective contour transitions in a direction of toe toward heel on the outsole.

19. The outsole of claim 18 wherein the base defines a plurality of channels, each of such channels surrounding each of the plurality of lugs.

20. The outsole of claim 19 wherein each of the plurality of channels is of a depth, and wherein the depth increases from toe to heel whereby channels closer to a heel region of the footwear are deeper than channels that are near a toe region of the footwear.

* * * * *